US010709229B2

(12) United States Patent
McGuinness

(10) Patent No.: US 10,709,229 B2
(45) Date of Patent: Jul. 14, 2020

(54) GARMENT AND ACCESSORY WITH BAG PULLING SYSTEM

(71) Applicant: Brian Edward McGuinness, New York, NY (US)

(72) Inventor: Brian Edward McGuinness, New York, NY (US)

( * ) Notice: Subject to any disclaimer, the term of this patent is extended or adjusted under 35 U.S.C. 154(b) by 31 days.

(21) Appl. No.: 15/949,836

(22) Filed: Apr. 10, 2018

(65) Prior Publication Data

US 2019/0307233 A1 Oct. 10, 2019

(51) Int. Cl.

| | |
|---|---|
| ***A45F 5/02*** | (2006.01) |
| ***A41F 9/00*** | (2006.01) |
| ***B65D 33/06*** | (2006.01) |
| ***A41D 27/00*** | (2006.01) |

(52) U.S. Cl.

CPC ..... *A45F 5/021* (2013.01); *A41D 27/00* (2013.01); *A41F 9/002* (2013.01); *B65D 33/065* (2013.01); *A41D 2400/48* (2013.01)

(58) Field of Classification Search

CPC .... A45F 5/004; A45F 2005/008; A44C 5/003; A45C 1/04; A45C 2011/007; B65D 83/0823; B65D 83/0829; B65D 83/0835; B65D 83/0847; B65D 83/830894; B65H 2402/411; B65H 75/4434

See application file for complete search history.

(56) References Cited

U.S. PATENT DOCUMENTS

| | | | | | |
|---|---|---|---|---|---|
| 3,559,854 | A * | 2/1971 | Loveland | A44C 5/003 | 224/219 |
| 4,536,889 | A * | 8/1985 | Taylor | A44C 5/0046 | 2/160 |
| 4,832,229 | A * | 5/1989 | Hackmann | B65D 83/0823 | 221/182 |
| 5,127,545 | A * | 7/1992 | French | A45F 5/00 | 221/102 |
| 5,299,712 | A * | 4/1994 | Carlson | B42D 5/005 | 221/185 |
| 5,864,925 | A * | 2/1999 | McGee | A45F 5/004 | 24/3.11 |
| 5,961,066 | A * | 10/1999 | Hambleton | B65H 35/0026 | 224/162 |
| 6,302,814 | B1 * | 10/2001 | Cade | A63B 67/10 | 473/576 |
| 6,881,273 | B1 * | 4/2005 | Oberman | A45F 5/004 | 134/6 |
| 7,735,682 | B1 * | 6/2010 | Cassel | A47K 10/38 | 221/155 |
| 8,002,113 | B1 * | 8/2011 | Cummings | B65D 85/672 | 206/408 |
| 2002/0036249 | A1 * | 3/2002 | Kettenbeil | A01M 31/00 | 242/379 |
| 2003/0010861 | A1 * | 1/2003 | Tsan | A45C 13/26 | 242/385.3 |

(Continued)

*Primary Examiner* — Brian D Nash

(74) *Attorney, Agent, or Firm* — Mannava & Kang, P.C.

(57) ABSTRACT

An accessory configured to carry a bag including a first layer of material and a second layer of material. The first layer of material and the second layer of material are configured to form a space therebetween. Additionally, the accessory includes a first opening configured to introduce an object into the space and a second opening in communication with a pulling system, wherein the pulling system is removably connected to an end of the object.

20 Claims, 9 Drawing Sheets

(56) References Cited

U.S. PATENT DOCUMENTS

2004/0045851 A1* 3/2004 Watari ..... A45C 11/00
206/409
2004/0173612 A1* 9/2004 Giraud ..... B65D 43/162
220/259.1
2005/0067449 A1* 3/2005 Jauvin ..... A41F 9/002
224/254
2005/0082323 A1* 4/2005 O'Hair ..... A45C 1/04
224/219
2005/0115999 A1* 6/2005 Johnson ..... A45F 5/004
224/269
2005/0199512 A1* 9/2005 Davidson ..... A45F 5/02
206/37
2007/0166095 A1* 7/2007 Samuelson ..... A45F 5/004
401/131
2007/0264165 A1* 11/2007 Chan ..... B65D 83/0829
422/400
2008/0173662 A1* 7/2008 Che ..... B65H 35/10
221/64
2009/0302079 A1* 12/2009 Lorenz ..... A45C 7/0077
224/577
2012/0055965 A1* 3/2012 Zhang ..... B65H 75/4434
224/269
2013/0104599 A1* 5/2013 Beldiman ..... A44C 5/003
63/1.14
2016/0088980 A1* 3/2016 Benmark Markovitch .....
A45F 5/022
221/45

* cited by examiner

GARMENT AND ACCESSORY WITH BAG PULLING SYSTEM

FIELD OF THE INVENTION

The present disclosure generally relates to garments and accessories having a pulling system. More specifically, the present disclosure relates to garments and accessories, such as a belt, that are configured to retain a pulling system. The pulling system can include a configuration to dispense at least one object, such as a plastic bag, from a container.

BACKGROUND OF THE INVENTION

The consumption of plastic bags has exponentially increased due to factors such as population growth, proliferation of consumer society, and lack of practical alternatives. For example, use of paper bags as an alternative to plastic bag causes depletion of trees. Moreover, it takes approximately 13% more energy to make a single paper bag than to make two plastic bags.

One easy way to reduce the number of plastic bags produced each year, is to re-use the bags. However, carrying one or multiple bags in a person's pocket, wallet or purse takes precious space. Accordingly, there is a need to carry plastic bags without the plastic bag occupying precious space in the user's pocket, wallet, purse, etc.

SUMMARY OF THE INVENTION

In an aspect, a garment or accessory includes a first layer and a second layer, wherein the first layer and the second layer are configured to form a space therebetween; and a pulling system incorporated into at least one of garment or accessory and in communication with the space formed between the first layer and the second layer.

In an aspect, the first layer and the second layer are made of at least one of a same material or a different material.

In an aspect, the pulling system comprises a spring configured to be directly or indirectly connected to an object.

In another aspect, when the spring is configured to be indirectly connected to an object, the spring is connected to a string that is connected to the object.

In a further aspect, the string is made of at least one of polymer, metal, and fabric.

In a further aspect, the spring is at least one of compression spring, extension spring, torsion spring, constant force spring, and Belleville spring.

In yet another aspect, the pulling system comprises a locking device actuator configured to lock or unlock at least one of a spring or a string of the pulling system.

In an aspect, the pulling system comprises a hook configured to be connected to an object being dispensed.

In a further aspect, the garment or accessory further includes a container configured to be positioned within at least a portion of the space between the first layer and the second layer and wherein the container comprises at least one object.

In an aspect, the at least one object is a plastic bag.

In an aspect, the container is configured to rotate around a vertical axis.

In another aspect, the container includes an opening and is configured to hold at least one object.

In a further aspect, the pulling system includes a locking device actuator and wherein the accessory is a belt having a belt buckle.

In yet another aspect, the belt buckle includes a bar and a prong and wherein the bar is connected to the locking device actuator.

In an aspect, the locking device actuator is configured to be connected to a movable clamp.

In another aspect, a bag that includes two handles and a loop positioned on a portion of the bag.

In a further aspect, the loop is made of the same material as the bag.

In yet another aspect, the bag is a plastic bag.

In an aspect, the loop is configured to withstand a force of at least 250 N.

In another aspect, one of the loops is smaller than the remaining two loops.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

BRIEF DESCRIPTION OF THE DRAWINGS

The present disclosure in its several aspects and embodiments can be more fully understood from the detailed description and the accompanying drawings, wherein.

and

Figure 9:
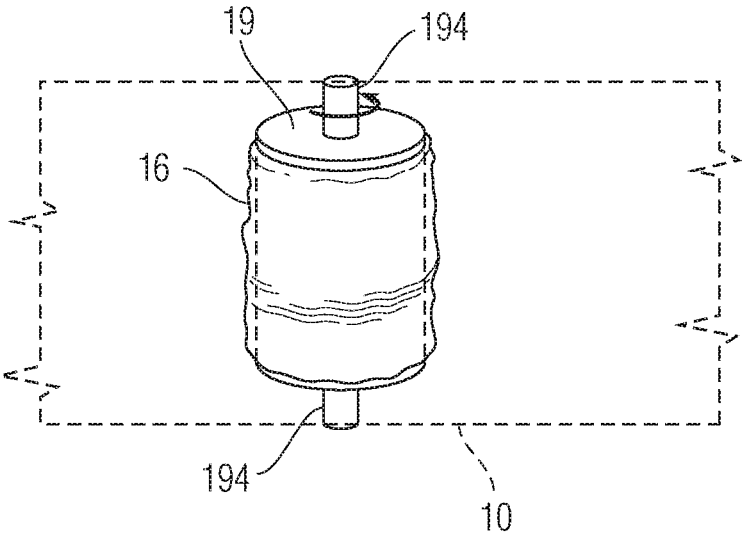

FIG. 9 is an alternative plastic bag container, according to an example of the present disclosure.

Throughout this specification and figures like reference numbers identify like elements.

DETAILED DESCRIPTION OF THE INVENTION

It is to be understood that both the foregoing general description and the following detailed description are exemplary and explanatory only, and are intended to provide an explanation of various embodiments of the present teachings.

The phrase "Accessory," as used herein, refers to any item that can be carried or be worn by a consumer, such as a belt, purse, wallet, eyeglass case, etc.

Although the present application specifically refers to a belt, the present invention can be incorporated into any accessory or garment.

In its broad and varied embodiments, disclosed herein a device which allows users to re-use objects, such as plastic bags; thereby reducing the number of plastic bags produced each year. The majority of world's population use plastic bags for different purposes, such as carrying groceries, picking up pet waste, etc., the same population do not have a plastic bag when in a grocery store or use new plastic bags when picking up pet waste. The present device allows the world population to have immediate access to a previously used plastic bag; thereby reducing the need to continue producing new plastic bags.

Figure 1A:
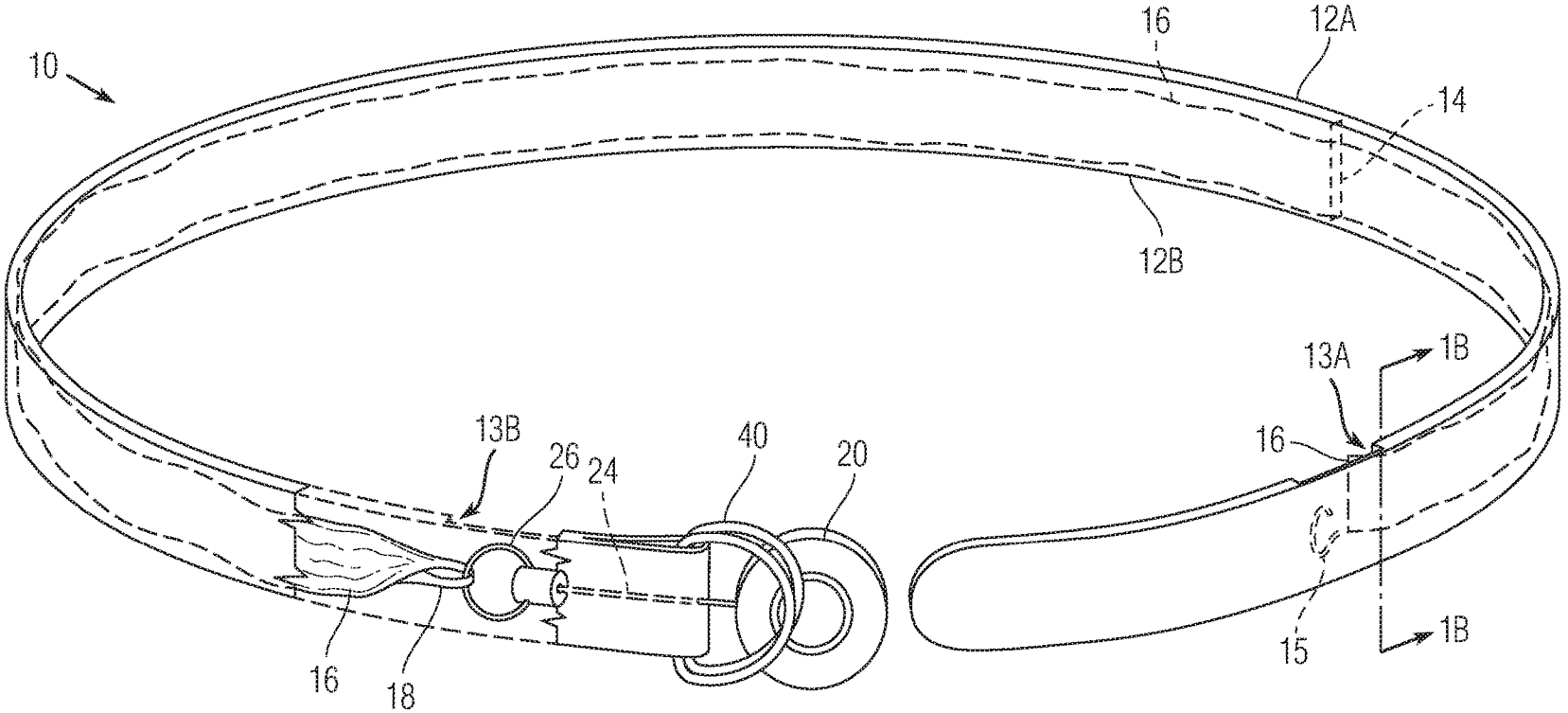
FIG. 1A is a perspective view of an exemplary belt having a pulling system and a plastic bag, according to an example of the present disclosure.
Figure 1B:
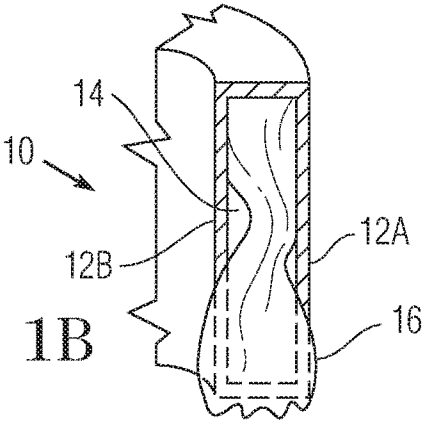
FIG. 1B is a cutaway of FIG. 1A at location 1B, according to an example of the present disclosure.

In an example, an object, such as a bag can be placed in a portion of a garment or an accessory. In an example, as shown in FIGS. 1A and 1B, belt 10 can include a bag 16. In this example, the belt 10 can include an outer layer (first layer) 12A and an inner layer (second layer) 12B. The first layer 12A and the second layer 12B are configured to create a space 14. Furthermore, the first layer 12A and the second layer 12B can be the same or can be different. For example, both the first layer 12A and the second layer 12B can be made of a material such as leather, canvas, rubber, or recycled material, such as recycled rubber, etc. In another example, when the first layer 12A is different from the second layer 12B, then the first layer 12A can be made of a material that is traditionally used in making the accessory, such as a belt, and the second layer 12B can be of a less expensive material. For example, the first layer 12A can be leather and the second layer 12B can be cotton or even a stretchable material.

In an example, the belt 10 can include a first opening 13A, a second opening 13B, a pulling system 20 having a spring mechanism that can be connected to a string 24 and hook-like device 26. In operation, to take out the bag 16 that is positioned in the space 14, a user can reach to the first opening 13A, where an end of the bag 16 is positioned in the vicinity of the first opening 13A and/or peeking out from the first opening 13A. The user can then grab the end of the bag 16 peeking out of the first opening 13A and pull the bag 16 out of the space 14. By pulling the bag 16 out of the first opening 13A, the user, inherently, also pulls out the hook-like device 26. The user can then disconnect a loop 18 of the bag 16 from the hook-like device 26. In one example, as shown in FIG. 1A, in order to prevent the hook-like device 26 from retracting back to the space 14, the hook-like device 26 can be secured to a securing device 15. The securing device 15 can be any device that is capable of temporarily or removably connect the hook-like device 26 to a vicinity of the first opening 13A. For example, the securing device 15 can be a hook.

To insert a new bag 16 in to the space 14, the user can disconnect the hook-like device 26 from the securing device 15 and connect the loop 18 portion of the new bag 16 onto the hook-like device 26. In an example, the hook-like device 26 can include a cut to create two ends substantially facing one another. The two ends can be configured such that they can be twisted or pulled apart to allow the loop 18 be inserted into the hook-like device 26. Once the bag 16 has been connected to the hook-like device 26, the spring mechanism in the pulling system 20 can cause the bag 16 that is connected to the hook-like device 26 to be pulled back into the space 14. In one example, the belt 10 can include an optional second opening 13B. This optional second opening 13B can be used to insert the string 24 and the hook-like device 26 of the pulling system into the space 14 of the belt 10. Once inserted, the second opening 13B can be closed. In another example, once the string 24 and hook-like device 26 of the pulling system have been inserted into the space 14, the second opening 13B can remain open.

The first and/or second openings 13A, 13B can be positioned anywhere on the belt 10. For example, each of the first and second openings 13A and 13B can be placed on the first layer 12A or on the second layer 12B. Additionally, each of the first and second openings 13A and 13B can be placed at the vicinity of each end of the belt 10 or at any other location on the belt 10. In the example shown in FIG. 1A, the first and second openings 13A and 13B are placed on the second layer 12B and at the vicinity of each end of the belt 10.

Figure 2A:
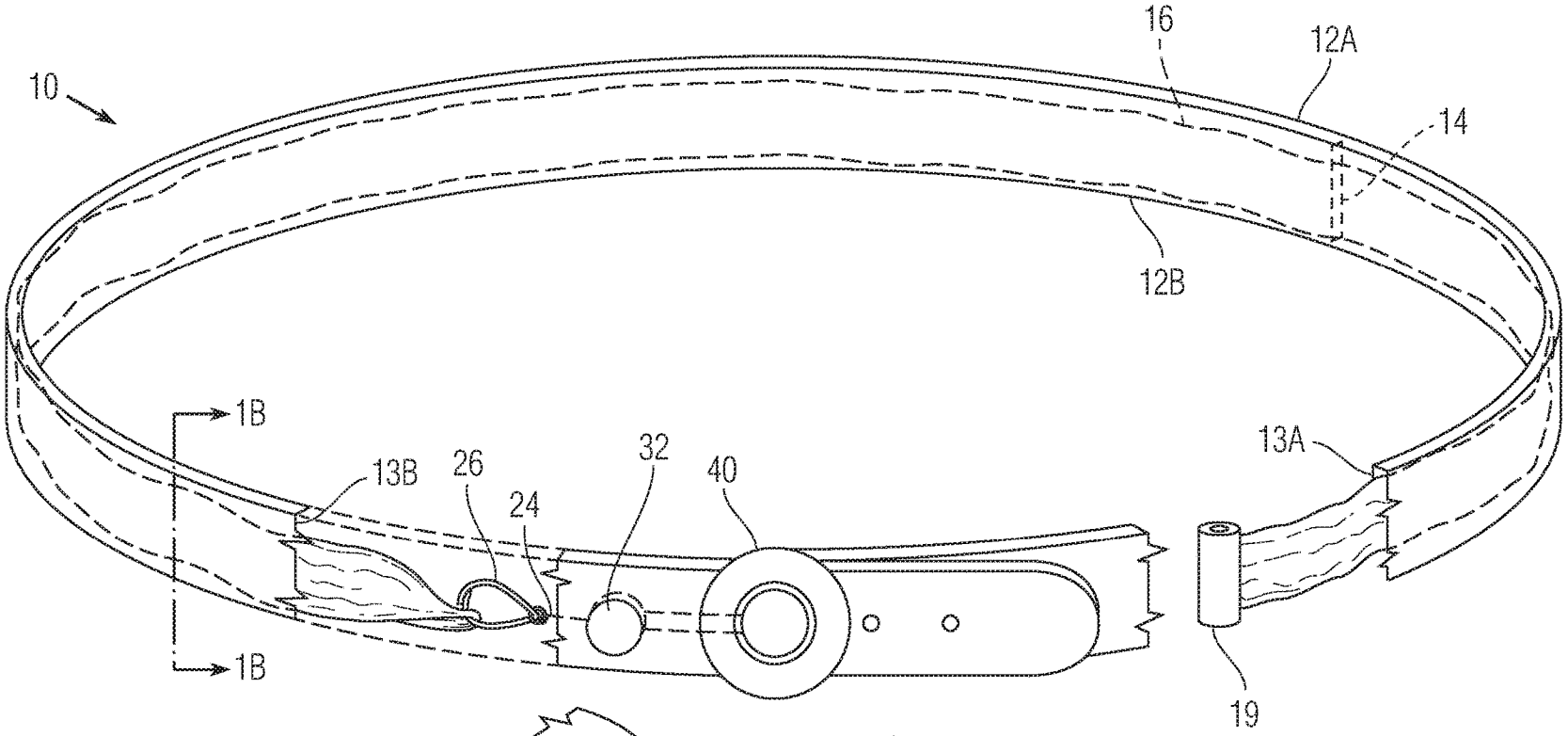
FIG. 2A is a perspective view of an alternative exemplary belt having a pulling system and a plastic bag, according to an example of the present disclosure.
Figure 2B:
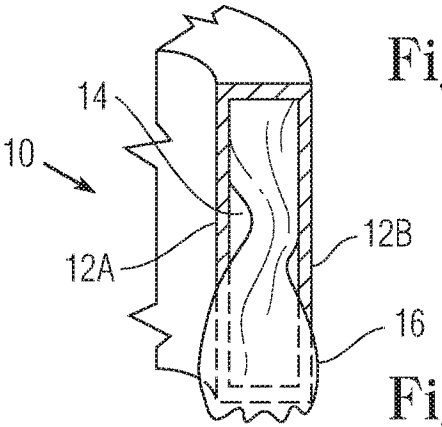
FIG. 2B is a cutaway of FIG. 2A at location 1B, according to an example of the present disclosure.

Another exemplary embodiment is illustrated in FIGS. 2A and 2B. In this exemplary embodiment, belt 10 can include at least one opening, such as the first opening 13A and/or the second opening 13B. In one example, as shown in FIG. 2A, the first opening 13A can be used to place the bag 16 and/or a container 19 containing at least one bag into the space 14 within the belt 10. To place the bag 16 into the space 14, the hook-like device 26 can be extended within the space 14 such that the hook-like device 26 is positioned in proximity of the first opening 13A. One end of the bag 16 having loop 18 can be connected to the hook-like device 26. Once connected, the pulling system can pull the bag 16 into the space 14, such that an end of the bag 16 is positioned in the vicinity of the second opening 13B for the user to grab and pull out, when needed. In one example, when the container 19 includes a plurality of bags 16, each bag 16 is connected to an end of the next bag 16. Therefore, when the first bag 16 is pulled out, the end of the next bag 16 is positioned at the vicinity of the second opening 13B for the user to pull out, when needed. Thus, the pulling system 20 can be used to take out the first bag and may not be required for the remaining bags to be pulled out of the container 19. The first and/or second openings 13A, 13B can be positioned anywhere in the belt 10. For example, they can be placed on the first layer 12A or on the second layer 12B. In the example shown in FIG. 2A, the first and second openings 13A and 13B are placed on the second layer 12B and at approximately at each end of the belt 10.

In one example, to more conveniently position a bag 16 in the space 14, a connecting device, such as a zipper or a tong and hook device can be placed on the inner layer 12B that extends from the first opening 13A to the second opening 13B. In this example, a user can open the zipper and pull the string 24 and the hook-like device 26 from the second opening 13B towards the first opening 13A. The hook-like device 26 can then be temporarily secured to the securing device 15 so that the user can close the zipper, such that the string 24 is within the space 14. The user can then secure an end of the bag 16 onto the hook-like device 26 so that the pulling system 20 can pull the bag 16 into the space 14.

Figure 3:
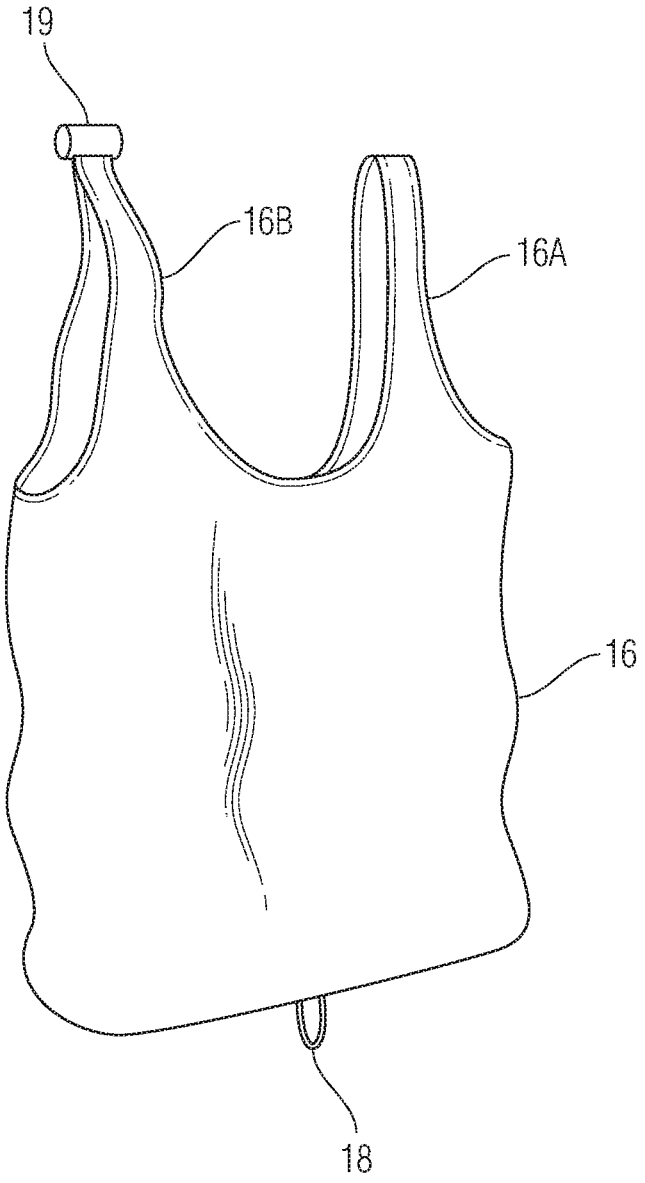
FIG. 3 is a plastic bag having a loop and a container, according to an example of the present disclosure.

The bag 16 can be any type of bag, such as a plastic bag that are traditionally used in the grocery stores. In one example, as shown in FIGS. 2A and 3, bag 16 can be a modified grocery bag, which includes a loop 18. Loop 18 can be positioned anywhere on the bag 16. As shown in FIG. 3, loop 18 can be connected to a portion of the bottom of the bag 16. However, it can also be connected or be part of the handles 16A and/or 16B or the side of the bag 16. Loop 18 can be used to connect the bag 16 to a portion of a pulling system 20. Loop 18 can be part of a bag when it was first manufactured or can be added to the bag as an add-on feature. When the loop 18 is an add-on feature, it can be made of any material, such as plastic, leather, cotton, etc. and it can be sewn or glued on to the bag. When the container 19 includes a plurality of bags 16 having loop 18, the loop 18 of the first bag 16 can be connected to a portion of the pulling system 20. Additionally, the handles 16A and/or 16B of the first bag 16 can be connected or attached to the loop 18 of the next bag 16. In one example, the loop 18 is smaller than the handles 16A and/or 16B. In another example, loop 18 can be the same size or even larger than the handles 16A and/or 16B. The loop 18 can be configured to withstand a force of at least 50 N, such as a force of at least 100 N, for example, a force of at least 200 N, or a force of at least 250 N.

In an example, if the bag 16 does not include a loop 18, a part of the bag 16 can be connected to a portion of the pulling system 20. For example, one or more of the handles 16A and 16B can be connected to a portion of the pulling system 20. In one example, when the container 19 includes a plurality of bags 16, the first handle 16A can be connected to a portion of the pulling system 20 and the second handle 16B can be connected to the first handle 16A of the next bag. If the bag does not include at least one handle, then each bag can be continuously connected to the next bag. In this example, each bag is separated from the next bag by perforation lines.

Figure 4:
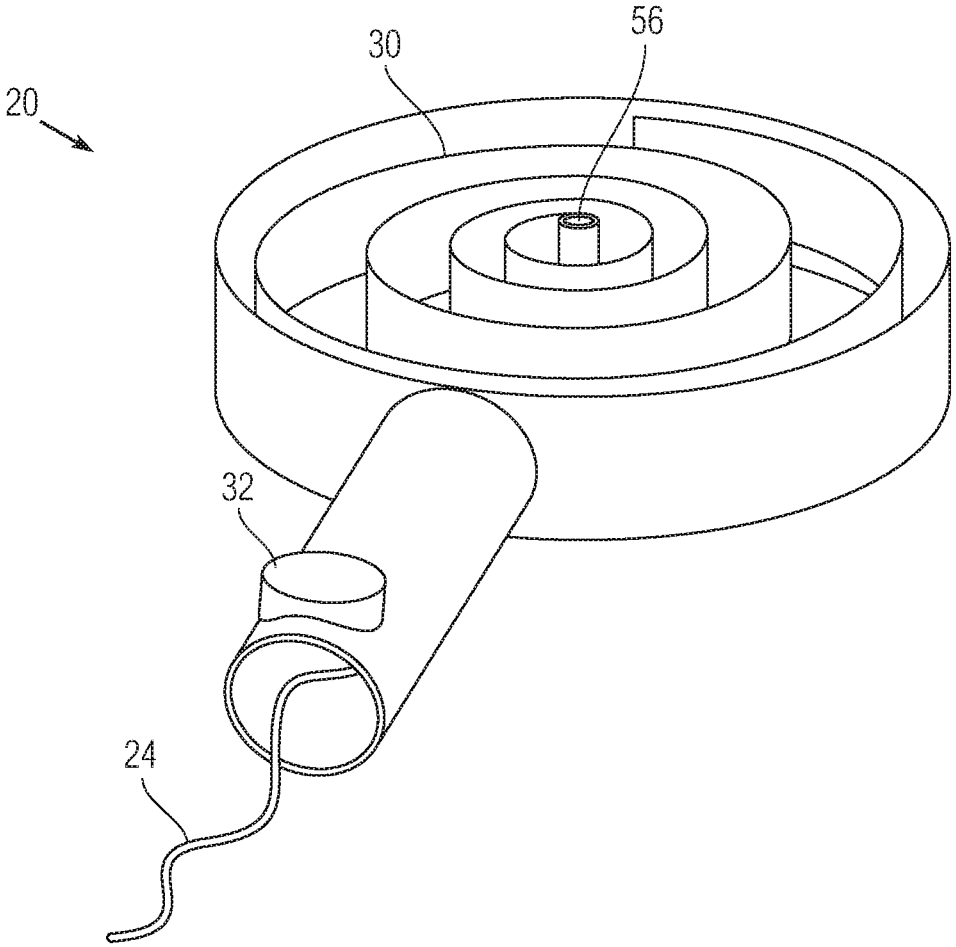
FIG. 4 is a perspective view of an exemplary pulling system, according to an example of the present disclosure.
Figure 5A:
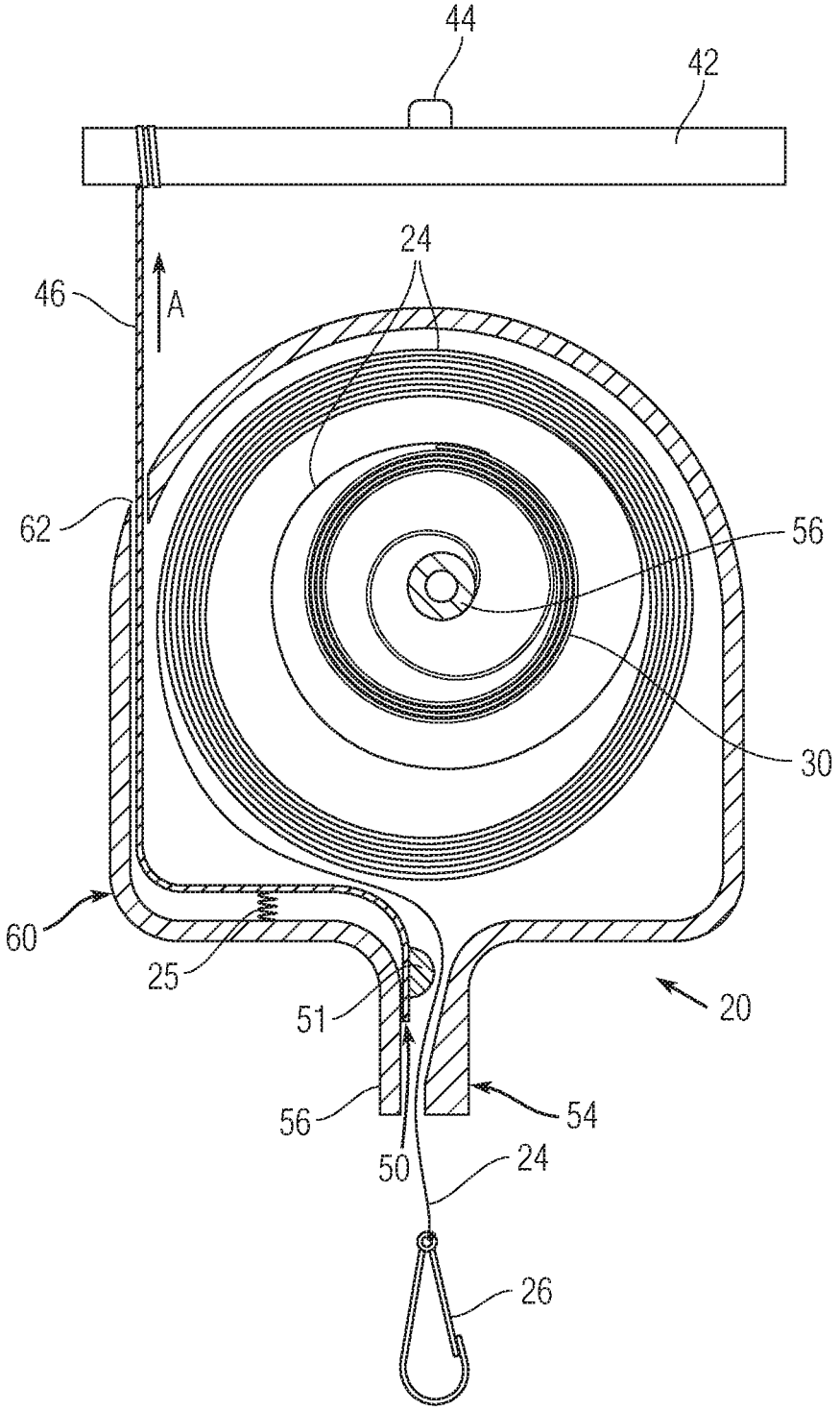
FIG. 5A is a top cutaway of an exemplary pulling system with the movable clamp in an open position and a locking device actuator being actuated by a bar of a belt buckle; according to an example of the present disclosure.
Figure 5B:
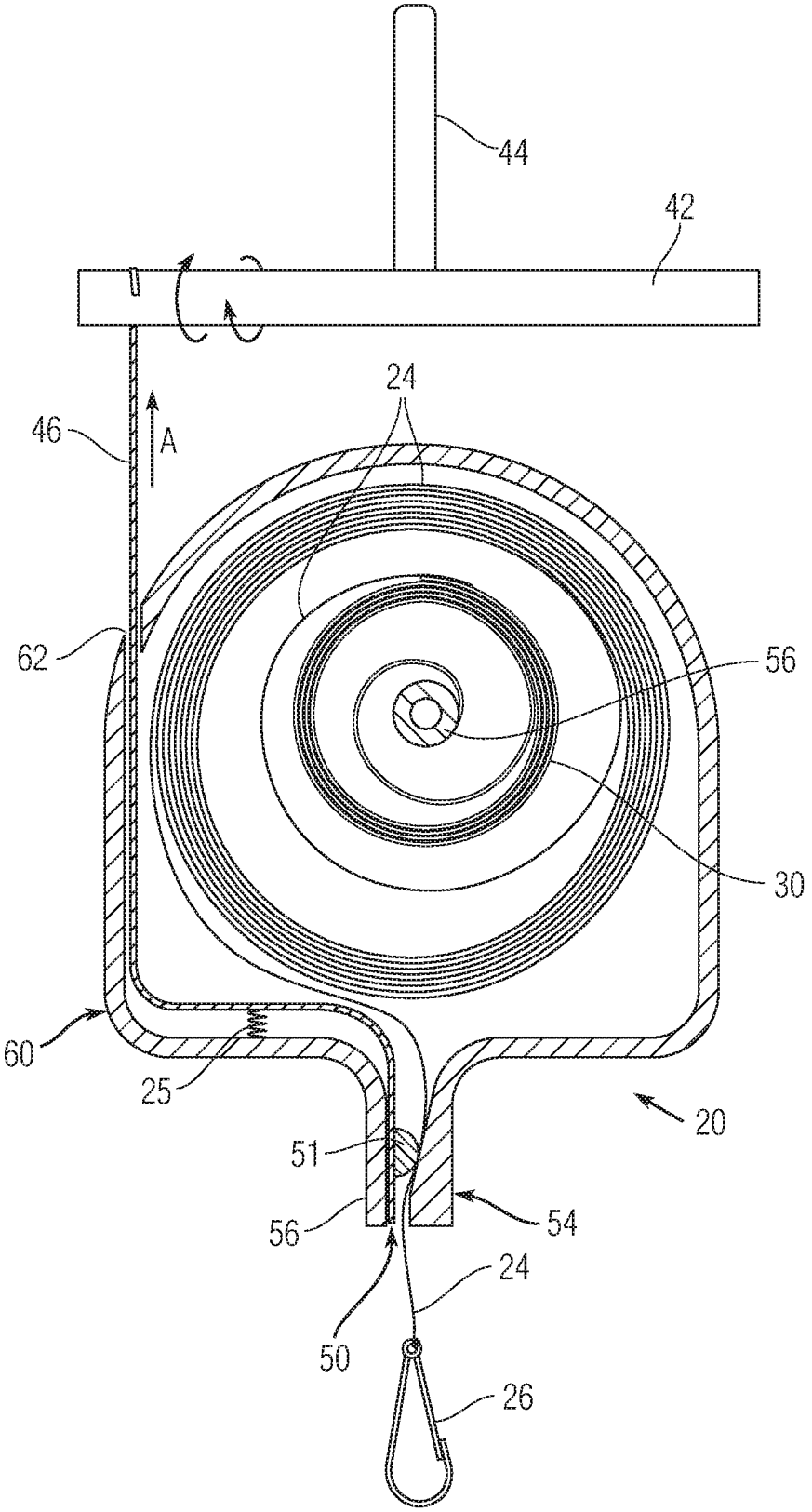
FIG. 5B is a top cutaway of an exemplary pulling system with the movable clamp in a closed position and the locking device actuator being actuated by a bar of a belt buckle; according to an example of the present disclosure.
Figure 5C:
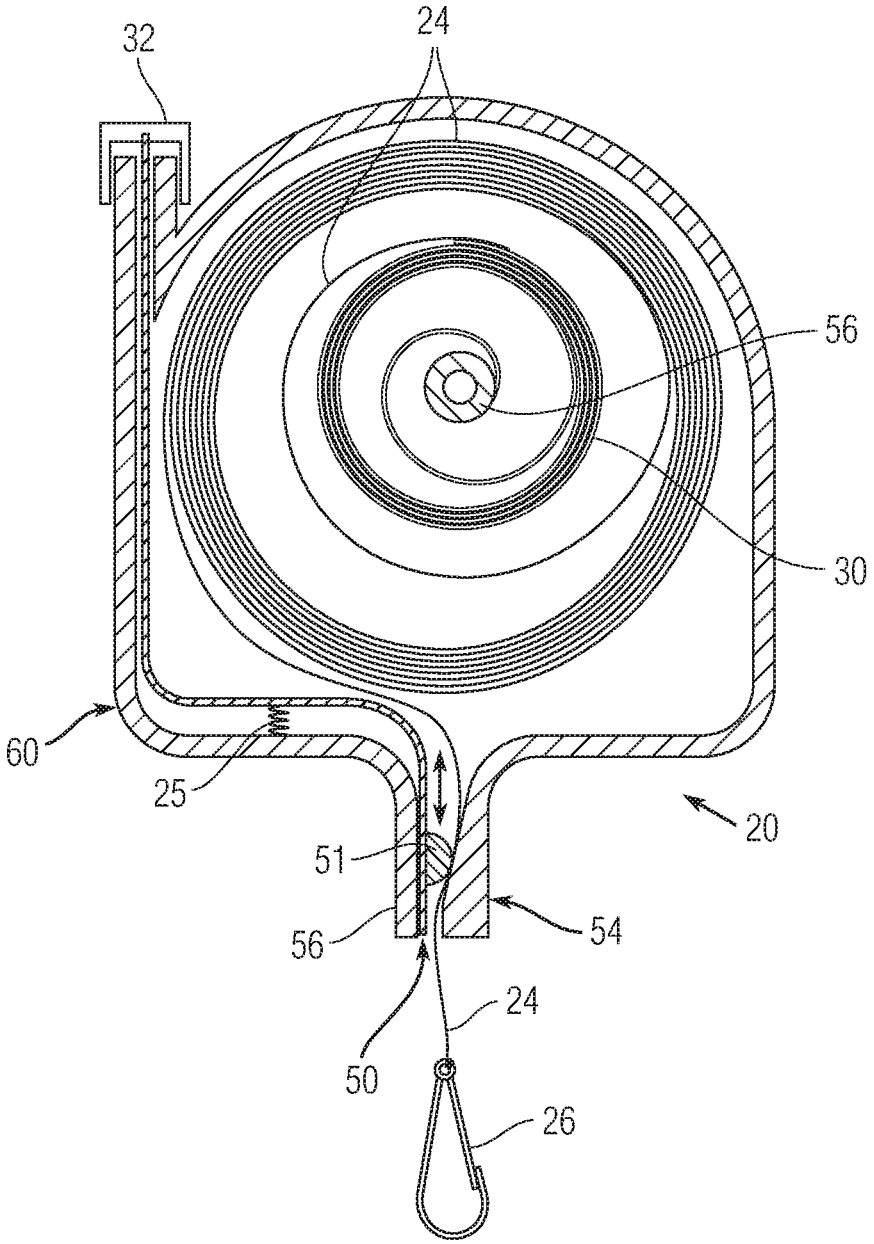
FIG. 5C is a top cutaway of an exemplary pulling system with the movable clamp in a closed position and the locking device actuator being actuated by a push button; according to an example of the present disclosure.

As shown in FIGS. 4-5C, the pulling system 20 can include a spring 30 that can be connected to a string 24 that can include a hook-like device 26. The string 24 can be made of any material, such as cotton, nylon, and/or metal. In one example, the string 24 can be made of nylon material. In one example, the spring 30 can be directly connected to the hook-like device 26. The spring 30 can be in a form of any spring, such as a compression spring, an extension spring, a torsion spring, a constant force spring, and a belleville spring to name a few. The examples shown in FIGS. 4-5C illustrate a constant force spring.

As shown in FIG. 4, the spring 30 and/or the string 24, if the pulling system also includes a string 24, can be locked in a position by a button 32. Alternatively or additionally, as shown in FIGS. 5A and 5B, if the pulling system 20 is used in a belt, the spring 30 and/or the string 24, if the pulling system also includes a string 24, can be locked in a position by a bar 42 of a buckle 40.

The spring 30 can be in a form of a coiled spring metal having its inner end fixed to the center post 56 and its outer end connected to the inner end of the string 24. (For purposes of discussion, the present invention only refers to string 24; however, if the pulling system does not include a string 24, then spring 30 will also act as the string 24. Therefore, spring 30 can be substituted for the string 24). The string 24 can be wound within the case and can include a hook-like device 26 used for connecting the string 24 to a portion of the bag 16, such as the loop 18.

As shown in FIGS. 5A-5C, a clamping mechanism can be positioned within the case, adjacent to the slot through which the string 24 protrudes. The clamping mechanism can include a ledge 54 that is configured such that the end portion of the ledge 54 includes a thickness that is greater than the thickness at the base of the ledge 54. The clamping mechanism can also include a movable clamp 50 having an upwardly protruding mass 51 adapted to engage the string 24 to lock the string 24 against the end portion of the ledge 54. A locking device actuator 46 can, at least partially, be positioned inside the case body 60 through opening 62. The locking device actuator 46 enables a user to move the protruding mass 51 to an unlock position, as shown in FIG. 5A or a lock position as shown in FIG. 5B. In one example, the locking device actuator 46 can be biased to its released condition by a spring 25, which can be located between the locking device actuator 46 and the sidewall of the case body 60. Spring 25 can be fixed to the locking device actuator 46. In another example, the locking device actuator 46 can be biased to its closed condition by a spring 25.

Figure 6:
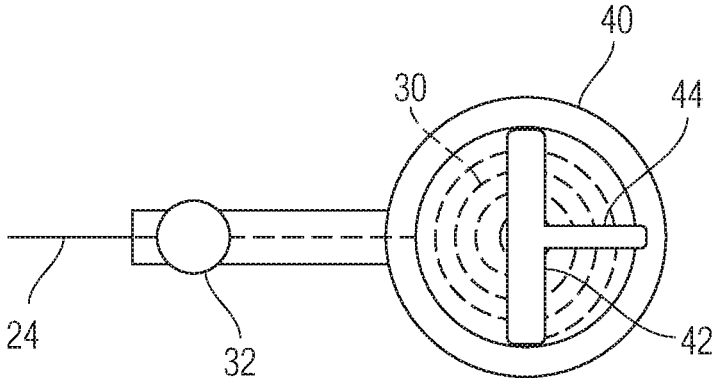
FIG. 6 is a top view of an exemplary pulling system and a belt buckle, wherein the pulling system is activated by a push button, according to an example of the present disclosure.
Figure 7:
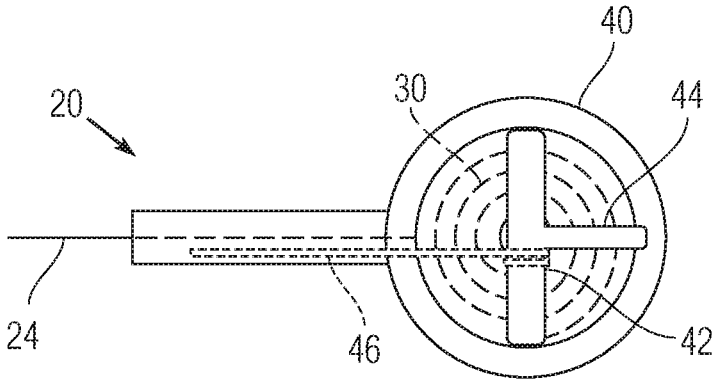
FIG. 7 is a is a top view of an exemplary pulling system and a belt buckle, wherein the pulling system is activated by a prong of the belt buckle, according to an example of the present disclosure.

The locking device actuator 46 can be manually operated by the button 32, as shown in FIG. 6 or, in case of a belt, by the bar 42 of the buckle 40, as shown in FIGS. 5A, 5B, and 7.

When the locking device actuator 46 is manually operated by the button 32, the locking device actuator 46 can be engaged with the button 32 that can protrude at an end of the case body 60, as shown in FIG. 5C, or can protrude on top of the case body 60, as shown in FIG. 6.

In an example, where the pulling system 20 is incorporated into a belt, the locking device actuator 46 can be operated by the bar 42 of the buckle 40, as shown in FIGS. 5A and 5B. In this example, the end portion of the locking device actuator 46 can be connected to the bar 42. As such, as shown in FIG. 5A, when the user pulls a prong 44 of the buckle 40 away from the buckle 40, (i.e., the prong 44 is perpendicular to the core of the user) it causes the bar 42 to rotate, thereby, pulling on the locking device actuator 46 in the direction A. Accordingly, the protruding mass 51 moves back towards the base of the ledge 54 that includes a thickness less than the end of the ledge 54, thereby releasing the string 24. Referring to FIG. 5B, when the user is wearing the belt 10, the prong 44 of the buckle 40 is not pulled back (i.e., the prong 44 is parallel to the core of the user), thus, the locking device actuator 46 is pushed-in, which causes the protruding mass 51 to also be pushed-in towards the end of the ledge 54, thereby securing the string 24 in its position.

In one example, if the string 24 is incorporated into the pulling system 20, a hook-like device 26 (shown in FIG. 1), at one end, can be connected to the string 24. The other end of the hook-like device 26 can be connected to the bag 16. In another example, if the string 24 is not incorporated into the pulling system 20, the hook-like device 26, at one end, can be connected to the spring 30 and the other end of the hook-like device 26 can be connected to the bag 16.

In operation, a user can place the container 19 having at least one bag 16 in the space 14 via the first opening 13A. In one example, the at least one bag 16 can be pulled through space 14, such that the loop 18 of the at least one bag 16 is within the vicinity of the second opening 13B. The hook-like device 26 of the pulling system 20 can then be connected to the loop 18. Alternatively, once the container 19 has been placed in the space 14 via the first opening 13A, the user can feed the hook-like device 26 of the pulling system 20 through the space 14 from the second opening 13B to the vicinity of the first opening 13A. The user can then connect the hook-like device 26 to the loop 18 of the bag 16.

Referring to FIGS. 2A and 6, in one example, to dispense at least one of the bags 16 from the belt having the container 19 and the pulling system 20, the user can press on the button 32 to retract the movable clamp 50, thereby releasing the string 24. Once the string 24 has been released, the spring 30 retracts and collects the string 24 and the hook-like device 26, which is connected to the loop 18 of the bag 16. As a result, the bag 16 is pulled through the space 14 of the belt 10 and out of the belt 10 through the second opening 13B.

Referring to FIGS. 5A, 5B, and 7, once the belt 10 is worn and the user needs the bag 16, the user can pull the prong 44 of the buckle 40 to retract the movable clamp 50, thereby releasing the string 24. Once the string 24 has been released, the spring 30 retracts and collects the string 24 and the hook-like device 26, which is connected to the loop 18 of the bag 16. As a result, the bag 16 is pulled through the space 14 of the belt 10 and out of the belt 10 through the second opening 13B.

Figure 8:
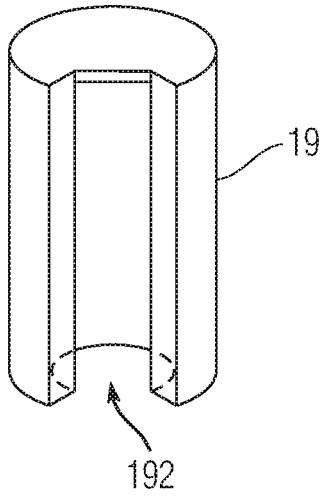
FIG. 8 is a plastic bag container, according to an example of the present disclosure.

Referring to FIG. 8, in one example, the contain 19 can include an opening 192. Depending on the size of the container 19, one or more of bags 16 can be placed inside of the container 19. If more than one bag 16 is placed inside the container 19, then each bag 16 needs to be connected to its adjacent bag 16, such that when the user pulls out the first bag 16, a portion of the second bag 16 is exposed through the second opening 13B.

Referring to FIG. 9, in one example, the contain 19 can include an axle 194 at each end of the container 19 to allow the container 19 to rotate around a vertical axis. One or more bags 16 can be wrapped around the container 19. As the first bag 16 is pulled by the pulling system 20, the container 19 can rotate to release the bag 16. As before, if more than one bag 16 is wrapped around the container 19, then each bag 16 needs to be connected to its adjacent bag 16, such that when the user pulls out the first bag 16, a portion of the second bag 16 is exposed through the second opening 13B.

From the foregoing description, those skilled in the art can appreciate that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

The scope of this disclosure is to be broadly construed. It is intended that this disclosure disclose equivalents, means, systems and methods to achieve the devices, activities and mechanical actions disclosed herein. For each device, article, method, mean, mechanical element or mechanism disclosed, it is intended that this disclosure also encompass in its disclosure and teaches equivalents, means, systems and methods for practicing the many aspects, mechanisms and devices disclosed herein. Additionally, this disclosure regards a coating and its many aspects, features and elements. Such a device can be dynamic in its use and operation, this disclosure is intended to encompass the equivalents, means, systems and methods of the use of the device and/or article of manufacture and its many aspects consistent with the description and spirit of the operations and functions disclosed herein. The claims of this application are likewise to be broadly construed.

The description of the inventions herein in their many embodiments is merely exemplary in nature and, thus, variations that do not depart from the gist of the invention are intended to be within the scope of the invention. Such variations are not to be regarded as a departure from the spirit and scope of the invention.

I claim:

1. A garment or accessory comprising:

a first layer and a second layer, wherein the first layer and the second layer are configured to form a space therebetween, and wherein the space is configured to hold a dispensable object;

a pulling system in communication with the space formed between the first layer and the second layer, wherein the first layer and the second layer forming the space are separate from the pulling system; and a container separate from the pulling system and configured to be positioned within at least a portion of the space between the first layer and the second layer, wherein the container comprises the dispensable object or a portion of the dispensable object.

2. The garment or accessory of claim 1, wherein the first layer and the second layer are made of a same material or a different material.

3. The garment or accessory of claim 1, further comprising a hook connected to an end of the pulling system and configured to connect to a portion of the dispensable object.

4. The garment or accessory of claim 1, wherein the pulling system comprises a spring configured to be directly or indirectly connected to an object.

5. The garment or accessory of claim 4, wherein the spring is at least one of compression spring, extension spring, torsion spring, constant force spring, or Belleville spring.

6. The garment or accessory of claim 1, wherein the pulling system comprises a locking device actuator configured to lock or unlock at least one of a spring or a string of the pulling system.

7. The garment or accessory of claim 1, wherein the pulling system comprises a hook-like device configured to removably connect the dispensable object to the pulling system.

8. The garment or accessory of claim 1, wherein the container is configured to rotate around a vertical axis.

9. The garment or accessory of claim 1, wherein the container comprises an opening.

10. The garment or accessory of claim 1, wherein the pulling system comprises a locking device actuator and wherein the accessory is a belt having a belt buckle.

11. The garment or accessory of claim 10, wherein the belt buckle comprises a bar and a prong and wherein the bar is connected to the locking device actuator.

12. The garment or accessory of claim 10, wherein the locking device actuator is configured to be connected to a movable clamp.

13. A garment or accessory comprising:

a first layer and a second layer, wherein the first layer and the second layer are configured to form a space therebetween, wherein the space is configured to hold a dispensable object, and wherein the dispensable object is a bag; and a pulling system in communication with the space formed between the first layer and the second layer, wherein the first layer and the second layer forming the space are separate from the pulling system.

14. The garment or accessory of claim 13, wherein the first layer and the second layer are made of a same material or a different material.

15. The garment or accessory of claim 13, further comprising a hook connected to an end of the pulling system and configured to connect to a portion of the dispensable object.

16. The garment or accessory of claim 13, wherein the pulling system comprises a spring configured to be directly or indirectly connected to an object.

17. The garment or accessory of claim 13, wherein the pulling system comprises a locking device actuator configured to lock or unlock at least one of a spring or a string of the pulling system.

18. The garment or accessory of claim 13, wherein the pulling system comprises a hook-like device configured to removably connect the dispensable object to the pulling system.

19. The garment or accessory of claim 13, wherein the pulling system comprises a locking device actuator and wherein the accessory is a belt having a belt buckle.

20. The garment or accessory of claim 19, wherein the belt buckle comprises a bar and a prong, wherein the bar is connected to the locking device actuator, and wherein the locking device actuator is configured to be connected to a movable clamp.

* * * * *